US008752625B2

(12) United States Patent
Tibbles

(10) Patent No.: US 8,752,625 B2
(45) Date of Patent: Jun. 17, 2014

(54) METHOD OF GRAVEL PACKING MULTIPLE ZONES WITH ISOLATION

(75) Inventor: Raymond J. Tibbles, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 619 days.

(21) Appl. No.: 13/025,835

(22) Filed: Feb. 11, 2011

(65) Prior Publication Data

US 2011/0203793 A1 Aug. 25, 2011

Related U.S. Application Data

(60) Provisional application No. 61/306,826, filed on Feb. 22, 2010.

(51) Int. Cl.
*E21B 43/04* (2006.01)

(52) U.S. Cl.
USPC ..... 166/278; 166/51; 166/387; 166/202; 166/187

(58) Field of Classification Search
CPC ..... E21B 43/04; E21B 33/1208
USPC ..... 166/278, 51, 387, 202, 187
See application file for complete search history.

(56) References Cited

U.S. PATENT DOCUMENTS

| | | | | |
|---|---|---|---|---|
| 4,945,991 | A | 8/1990 | Jones | |
| 5,588,487 | A | 12/1996 | Bryant | |
| 6,298,916 | B1 | 10/2001 | Tibbles et al. | |
| 6,311,772 | B1 | 11/2001 | Myhre et al. | |
| 6,668,938 | B2 | 12/2003 | Sheffield et al. | |
| 7,100,691 | B2 | 9/2006 | Nguyen et al. | |
| 7,152,677 | B2 | 12/2006 | Parlar et al. | |
| 7,357,177 | B2 | 4/2008 | Garwood et al. | |
| 7,431,098 | B2 | 10/2008 | Ohmer et al. | |
| 7,562,709 | B2 * | 7/2009 | Saebi et al. | 166/278 |
| 2005/0039917 | A1 | 2/2005 | Hailey, Jr. | |
| 2005/0045327 | A1 | 3/2005 | Wang et al. | |
| 2005/0045329 | A1 | 3/2005 | Wetzel et al. | |
| 2005/0082061 | A1 | 4/2005 | Nguyen et al. | |

(Continued)

FOREIGN PATENT DOCUMENTS

| | | |
|---|---|---|
| WO | WO2004094769 | 11/2004 |
| WO | WO2005031105 | 4/2005 |
| WO | WO2005042909 | 5/2005 |
| WO | WO2011103038 | 8/2011 |

OTHER PUBLICATIONS

Schlumberger Brochure TSL-4551, "Alternate Path Technology, Higher Production From Gravel-Packed Wells," May 2001, 8 pages total.

*Primary Examiner* — Jennifer H Gay
*Assistant Examiner* — George Gray
(74) *Attorney, Agent, or Firm* — Patrick A. Traister; Brandon S. Clark

(57) ABSTRACT

A gravel pack system and method for zonal isolation includes a swellable element used in conjunction with a primary isolation device, such as a cup packer. The zones may be isolated by both the isolation device and the swellable element. Shunt tubes may be used to convey a gravel slurry to each zone. At least one upper shunt tube extends through the isolation device to provide the slurry to the zone therebelow. Once the gravel packing is completed, the swellable member may be activated to provide and supplement a hydraulic seal between adjacent zones.

20 Claims, 3 Drawing Sheets

(56) References Cited

U.S. PATENT DOCUMENTS

2005/0199401 A1 9/2005 Patel et al.
2005/0279501 A1 12/2005 Surjaatmadja et al.
2008/0066900 A1 3/2008 Saebi et al.
2009/0229816 A1 9/2009 Lemme et al.
2009/0242189 A1 10/2009 Vaidya et al.

* cited by examiner

METHOD OF GRAVEL PACKING MULTIPLE ZONES WITH ISOLATION

CROSS-REFERENCE TO RELATED APPLICATIONS

This application claims benefit of and priority to U.S. provisional patent application having Ser. No. 61/306,826 that was filed on Feb. 22, 2010. The entirety of which is incorporated by reference herein.

BACKGROUND

Hydrocarbon fluids, such as oil and natural gas, are commonly obtained from subterranean geologic formations by drilling a well that penetrates a hydrocarbon-bearing formation. Once a wellbore has been drilled, the well must be completed before the fluids can be produced from the well. A typical completion involves the design, selection, and installation of equipment and materials in or around the wellbore for conveying, pumping, or controlling the production or injection of fluids therein. After the well has been completed, production of the hydrocarbon fluids can begin.

When the hydrocarbon fluid is eventually produced from the subterranean formation, the fluid typically contains particulates, such as sand. Problems caused by sand production can significantly increase operational and maintenance expenses and can potentially lead to a total loss of the well. To control sand production, one technique commonly employed involves the installation of a gravel packing system in the wellbore where the well fluid is routed through a downhole filter formed from gravel that surrounds a sand screen.

More specifically, the sand screen is a cylindrical mesh apparatus that is disposed around the production tubular and arranged generally concentric with the borehole where well fluid is produced. Gravel is packed between the annulus formed between the formation and the sand screen. The well fluid produced from the hydrocarbon formation passes through the gravel, enters the sand screen and is eventually communicated uphole via the production tubular. The gravel surrounding the sand screen is typically introduced into the well in the form of a slurry comprising a mixture of a carrier fluid and gravel. The gravel packing system directs the slurry around the sand screen so that when the fluid in the slurry disperses, the gravel remains seated around the sand screen.

In some applications, such as when relatively long formations are being gravel-packed, zonal isolation is undertaken to define and isolate multiple zones along the length of the wellbore. Conventionally, zonal isolation is accomplished using manmade isolation devices, such as cup packers, which can be bypassed for gravel packing using shunt tubes. However, the combination of shunt tubes and cup-type isolation packers often fails to provide sufficient isolation between adjacent zones.

There is a need, therefore, for improved tools and methods for providing an adequate bather and isolating multiple hydrocarbon zones.

SUMMARY

A gravel pack apparatus for use in a wellbore and method for using the same are provided. In at least one specific embodiment, the apparatus can include a screen assembly to filter particulates, the screen assembly being disposed around a completion string tubular, and an isolation device, such as a cup packer, disposed within the wellbore and configured to sealingly engage an inside surface of the wellbore to isolate a first wellbore zone from a second wellbore zone. The apparatus can further include upper and lower shunt tubes disposed within the wellbore and configured to convey a gravel slurry to the first and second wellbore zones, wherein the upper shunt tube passes through the isolation device to convey the gravel slurry to the second wellbore zone. A swellable element can also be disposed on the completion string tubular between the first and second wellbore zones and configured to swell in response to an input stimulus to sealingly engage the inside surface of the wellbore. In operation, the swellable element prevents fluid communication between the first and second wellbore zones within the wellbore and further prevents fluid communication between the upper and lower shunt tubes.

In at least one specific embodiment, the method can include running a completion string into the wellbore, the completion string having a screen assembly, a packer configured to sealingly engage an inside surface of the wellbore and isolate a first wellbore zone from a second wellbore zone, upper and lower shunt tubes, and a swellable element disposed between the first and second wellbore zones. The method can further include conveying a gravel slurry to the first and second wellbore zones through the upper and lower shunt tubes, wherein the upper shunt tube passes through the packer to convey the gravel slurry to the second wellbore zone. In response to an input stimulus, the swellable element can then expand from a first diameter to a second larger diameter to sealingly engage the inside surface of the wellbore and prevent fluid communication between the first and second wellbore zones and between the upper and lower shunt tubes.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
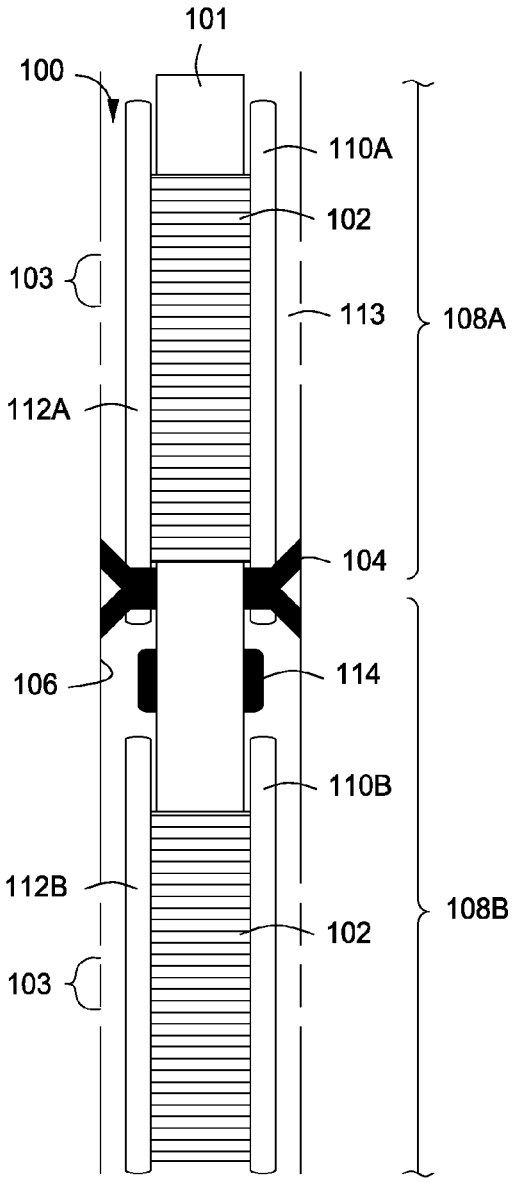
FIG. 1 depicts an illustrative wellbore prior to gravel packing operations, according to one or more embodiments described.

FIG. 1 depicts an illustrative wellbore 100 prior to gravel packing operations, according to one or more embodiments. As depicted, a completion string 101 can be disposed within the wellbore 100. The wellbore 100 has a plurality of perforations 103 that allow fluid communication between the wellbore 100 and a surrounding subterranean hydrocarbon formation. The completion string 101 can include one or more screen assemblies 102 and one or more isolation devices 104.

The screen assemblies 102 can include one or more screens (or other types of filtering structures) adapted to filter particulates so that the particulates are not produced into the completion string 101. In at least one embodiment, the screen assembly 102 includes an inflow/outflow control device ("ICD"), where the screen is a sand screen and the ICD is configured to control the inflow of hydrocarbons. In other embodiments, instead of fluid production to the surface, the completion string 101 can be used for injecting fluids into the surrounding formation to prepare the hydrocarbon formation for hydrocarbon recovery.

Each isolation device 104 can be made up between joints of screen assemblies 102 and/or blank pipe, and run in the wellbore 100 with the completion string 101. In one or more embodiments, each isolation device 104 can be generally formed of a hardened rubber material configured to sealingly engage the inside surface 106 of the wellbore 100. In one or more embodiments, in order to engage the isolation device 104, a pressurized fracturing or treating fluid can be pumped from the earth's surface through the completion string 101 and force the isolation device 104 to engage the inner surface 106 of the wellbore 100. Upon engaging or otherwise installing the isolation device 104, at least two zones 108A and 108B are defined, as illustrated. It should be noted, however, that if a different number (one or more than two) of isolation devices are used, then any number of zones may be defined and isolated from each other.

The isolation devices 104 can include a variety of downhole manmade isolation devices, such as, but not limited to, cup packers, swellable packers, inflatable packers, mechanical set packers, or combinations thereof. In one or more embodiments, various different types of cup packers may be implemented without departing from the scope of the disclosure. For example, embodiments may employ the cup packers disclosed and described in U.S. Pat. No. 6,668,938 entitled "Cup Packer," or U.S. Pat. No. 7,357,177 entitled "Restriction Tolerant Packer Cup," the contents of which are incorporated herein by reference, insofar as they are not inconsistent with the present disclosure.

Also illustrated in FIG. 1, and forming part of the completion string 101, are shunt tubes 110A, 110B, 112A, and 112B. The shunt tubes 110A,B and 112A,B can be generally positioned in the annulus 113 formed between the wellbore 100 and the completion string 101. The shunt tubes 110A,B and 112A,B can be used to carry a gravel slurry to the various zones 108A, 108B to provide a gravel packing system. As further illustrated in FIG. 1, the upper shunt tubes 110A and 112A may pass or otherwise extend through the isolation device(s) 104, thereby providing a conduit to freely convey gravel to the second wellbore zone. The lower shunt tubes 110B and 112B may also extend through one or more lower isolation devices (not shown) to provide a conduit for gravel to lower isolated zones. Although not specifically depicted, the shunt tubes 110A,B and 112A,B may include several side ports that allow for gravel slurry to exit the shunt tubes 110A,B and 112A,B at discrete locations along the length of each shunt tube 110A,B and 112A,B. As used herein, the terms "upper" and "lower" and other like terms refer to relative positions to one another and are not intended to denote a particular direction or spatial orientation.

In at least one embodiment, the shunt tubes 110A,B and 112A,B can ameliorate gravel bridging obstacles and also provide conduits whereby the gravel slurry may bypass manmade isolation devices, such as the isolation devices 104. The shunt tubes 110A,B and 112A,B can be used to channel the gravel slurry and bypass such obstacles so that a good gravel fill is provided throughout each zone 108A, 108B. As can be appreciated, in different implementations of the present invention, different numbers of shunt tubes can be used without departing from the scope of the disclosure.

The completion string 101 can also include one or more swellable elements 114 (also referred to as swellable packers) disposed between the first and second zones 108A, 108B. In at least one embodiment, the swellable elements 114 can be configured to swell from a first diameter to a second, larger diameter in response to some type of input stimulus. As a result, the swellable elements 114 expand to sealingly engage the inner surface 106 of the wellbore 100. Accordingly, the swellable elements 114 radially swell or expand, thereby exerting radial forces on the inner surface 106 of the wellbore 100 such that a sealing barrier is provided to further isolate the different zones 108A, 108B. As can be appreciated, any number of swellable elements 114 can be employed without departing from the scope of the disclosure. In at least one embodiment, two or more swellable elements 114 can be deployed between adjacent zones to enhance zonal isolation.

The input stimulus that causes swelling of the swellable elements 114 can include stimulus due to exposure to a downhole environment. For example, the material that makes up the swellable elements 114 may be selected to expand in the presence of one specific substance, such as water or a hydrocarbon fluid. In other embodiments, the swellable elements 114 may be formed of composite materials or from materials that swell when exposed to other swell-inducing substances. In some embodiments, the swellable material is selected based on naturally-occurring fluids found in the wellbore and to which the swellable elements 114 can be exposed at controlled, predetermined intervals. In other embodiments, the swellable elements 114 are selected such that they expand when exposed to a specific substance pumped along the flow path defined between vertically-adjacent shunt tubes 110A,B and 112A,B, thereby coming into contact with the swellable elements 114 at predetermined times during a given application.

In some implementations, the swellable elements 114 can be formed of elastomers that expand upon exposure to well fluids at elevated temperatures or pressures. In other implementations, the swellable elements 114 expand in response to chemical activation, such as the release of an activating agent within the wellbore 100. The activating agent can be stored in some container (not shown) that is sealed prior to deployment in the wellbore 100. The activating agent may be derived from the container to communicate with the swellable elements 114 such that the swellable elements 114 are caused to chemically swell. In yet another implementation, the swellable elements 114 can be inflatable bladders that are filled with a fluid (e.g., a gas or a liquid) to cause the swellable elements 114 to expand and thereby engage the inner surface 106 of the wellbore 100.

During run-in of the completion string 101, the swellable elements 114 encompass an outer diameter that is less than the inner diameter (i.e., the inner surface 106) of the wellbore 100. The annular clearance around the swellable elements 114, therefore, allows fluid and gravel to flow around the swellable elements 114 during gravel packing operations (arrows A in FIG. 2). Also, each swellable element 114 can have a relatively long sealing length, such as on the order of several feet. In permeable formations, the swellable elements 114 can provide and supplement reasonable isolation because pressure drop is length dependent. The swellable elements 114 can also seal in a larger range of wellbore sizes because they are able to expand beyond the run-in outer diameter.

In other embodiments, various different types of swellable elements 114 may be implemented without departing from the scope of the disclosure. For example, contemplated are embodiments employing swellable elements 114 such as those disclosed and described in U.S. Pat. Pub. No. 2009/0242189 entitled "Swell Packer," or U.S. Pat. Pub. No. 2009/0229816 entitled "Swell Packer and Method of Manufacturing," the contents of which are incorporated herein by reference, insofar as they are not inconsistent with the present disclosure.

The swelling of each swellable element 114 can generally conform to the inner surface 106 of the wellbore 100, even in the presence of any loose gravel or other material inadvertently disposed in the region to be sealed. As can be appreciated, this can prove advantageous in applications where the isolation devices 104 fail to provide adequate sealing isolation between zones 108A,B. For example, isolation devices 104 can frequently fail to completely seal against the inner surface 106 of the wellbore 100, especially in instances where sand or gravel becomes lodged between the inner surface 106 and the isolation devices 104. Where isolation devices 104 fail to adequately seal, their ability to sustain the necessary differential pressure during the subsequent treatment of another formation zone is severely diminished. Thus, the swellable element 114 can provide and supplement the needed additional sealing.

Especially in wellbores 100 producing gaseous hydrocarbons, employing the swellable element 114 can further prove advantageous because it not only serves to seal off fluid communication between zones 108A,B via the inner annulus 113, but also between vertically-adjacent shunt tubes 110A,B and 112A,B. Therefore, the swellable elements 114 help provide a better hydraulic seal that not only improves the seal with the inner surface 106 of the wellbore 100, but also isolates hydrocarbon fluid flow to only the completion string 101 (e.g., a production tubular disposed therein). Whereas, without the additional swellable element 114 seal, gaseous hydrocarbons could instead be susceptible to fluid communication via vertically-adjacent shunt tubes 110A,B and 112A,B.

Figure 2:
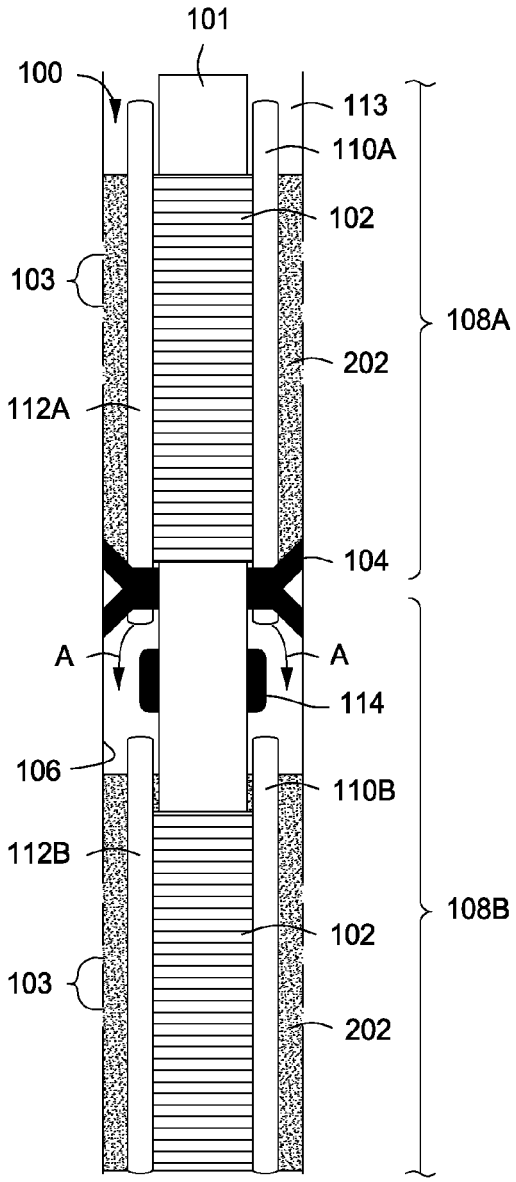
FIG. 2 depicts the illustrative wellbore after gravel packing operations, according to one or more embodiments described.

FIG. 2 depicts the wellbore after gravel packing has been undertaken, according to one or more embodiments. As depicted, the target annulus 113 between the completion string 101 and the inner surface 106 of the wellbore 100 is at least partially filled with a gravel pack derived from a gravel slurry 202. In operation, the gravel slurry 202 can be introduced into the annulus 113 and fill a first zone 108A. After filling the first zone 108A with gravel slurry 202, any overflow of the slurry 202 is channeled to the second zone 108B via the upper shunt tubes 110A and 112A which feed the annulus 113 below the isolation devices 104. The overflow slurry 202 flows out of the upper shunt tubes 110A, 112A, around the un-swelled swellable element 114, and into both the annulus 113 of the second zone 108B and the lower shunt tubes 110B, 112B, as indicated by the arrows A. As can be appreciated, this process can be repeated multiple times along the length of the completion string 101, thereby gravel packing multiple zones.

Figure 3:
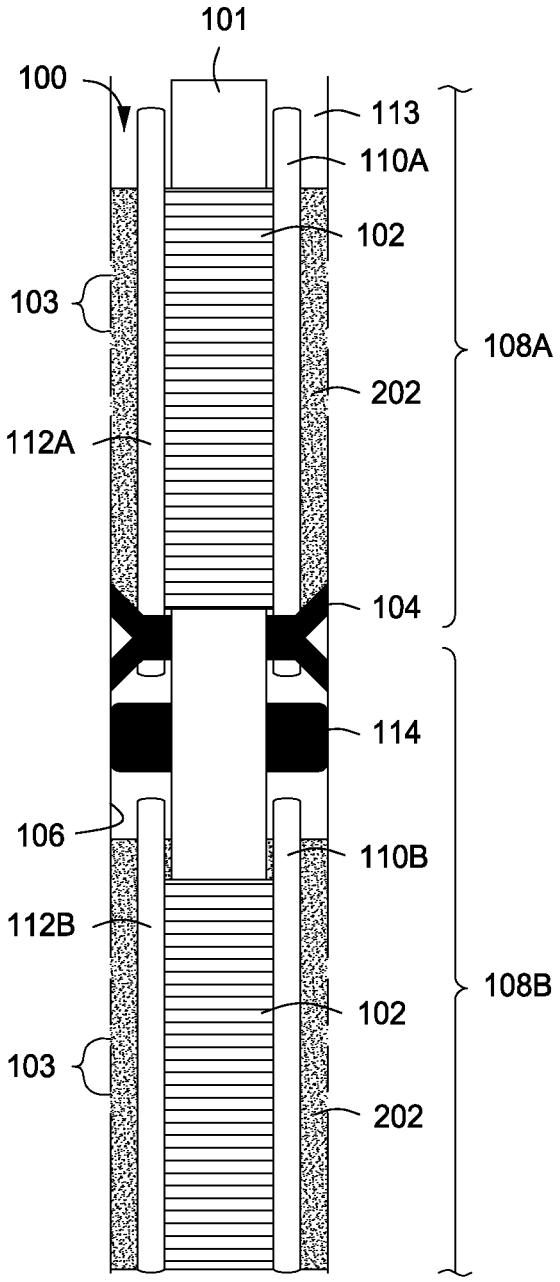
FIG. 3 depicts the illustrative wellbore after an illustrative swell packer has been deployed, according to one or more embodiments described.

Referring now to FIG. 3, depicted is the additional isolation effect that occurs once the swellable element 114 has been activated below the primary isolation device 104. As described above, the swellable element 114 can be activated via several processes or triggers including, but not limited to, swelling from contact with the reservoir fluid or swelling from contact with another fluid that is circulated into the well. In at least one embodiment, the input stimulus that activates the swellable element 114 may include the gravel slurry 202, or a chemical substance included within the gravel slurry 202. According to embodiments disclosed herein, each zone 108A,B along the wellbore 100 can be gravel-packed in a single run-in and pumping sequence, but a more complete isolation can also be achieved by employing the swellable element 114 in conjunction with the isolation devices 104.

Figure 4:
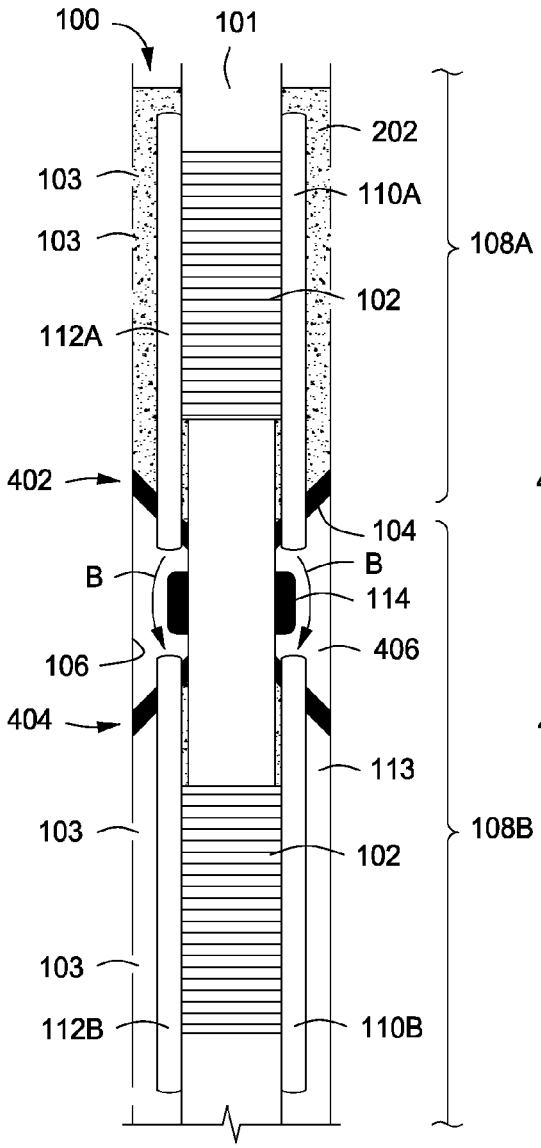
FIG. 4 depicts another illustrative wellbore prior to gravel packing operations, according to one or more embodiments described.
Figure 5:
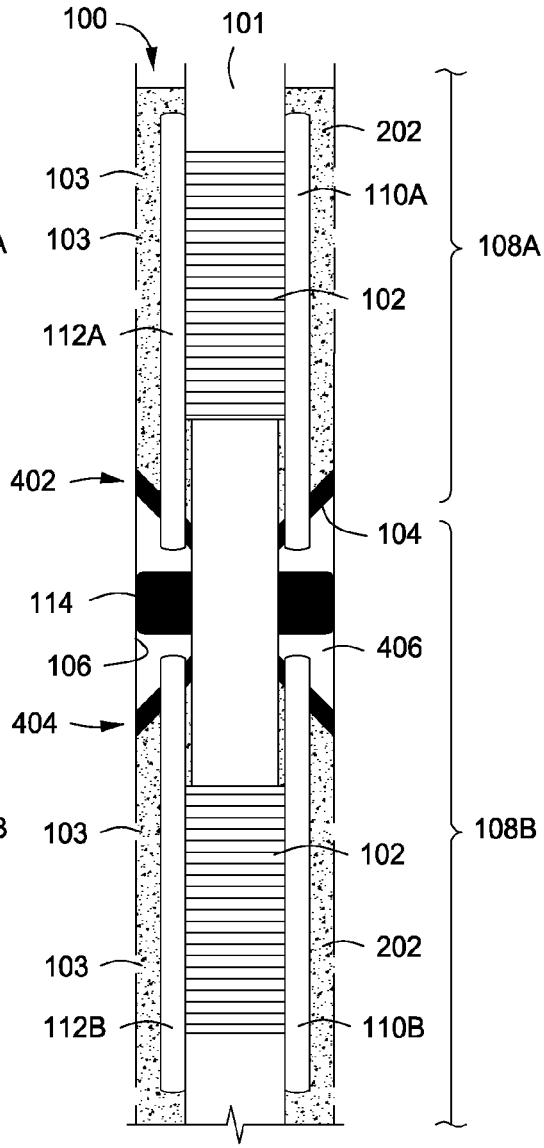
FIG. 5 depicts the illustrative wellbore of FIG. 4 after an illustrative swell packer has been deployed, according to one or more embodiments described.

Referring to FIGS. 4 and 5, depicted is another embodiment of a gravel pack system, according to one or more embodiments. The system shown in FIGS. 4 and 5 may be similar in some respects to the gravel pack system described above with reference to FIGS. 1-3. Accordingly, the gravel pack system of FIGS. 4 and 5 may be best understood in view of FIGS. 1-3, where like numerals designate like components and therefore will not be described again in detail. As depicted, the swellable element 114 may be arranged or otherwise interposed between an upper portion 402 and a lower portion 404 of the isolation device 104. Once engaged or otherwise deployed, the upper and lower portions 402, 404 of the isolation device 104 effectively separate or isolate the upper wellbore zone 108A from the lower wellbore zone 108B. In at least one embodiment, the isolation 104 device is a cup packer with the swellable element 114 built directly into its interior 406.

The upper shunt tubes 110A and 112A can be configured to penetrate the upper portion 402 of the isolation device 104, while the lower shunt tubes 110B and 112B penetrate the lower portion 404 of the isolation device 104. Accordingly, the first and second wellbore zones 108A,B can be in fluid communication via the upper and lower shunt tubes 110A,B and 112A,B which communicate via the interior 406 of the isolation device 104.

With the swellable element 114 in its unswelled state, as depicted in FIG. 4, gravel slurry 202 can be added to the annulus 113 of the wellbore 100, thereby filling the first wellbore zone 108A with slurry 202. After filling the first zone 108A with gravel slurry 202, overflow slurry 202 can be funneled down the upper shunt tubes 110A and 112A and into the lower shunt tubes 110B, 112B to feed the lower zone 108B, as indicated by the arrows B.

As described above, an input stimulus can serve to deploy or otherwise activate the swellable element 114, thereby swelling the element 114 and sealing the inside surface 106 of the wellbore 101, as depicted in FIG. 5. In one embodiment, the input stimulus may include the gravel slurry 202, or a chemical substance included within the gravel slurry 202. As the slurry 202 is transferred between the upper and lower shunt tubes 110A,112B, and 110B,112B, respectively, the swellable element 114 may come into contact with the input stimulus and swell to its fully engaged state. As described above, other input stimuli can include, but are not limited to, reservoir fluid or another fluid circulated into the well, or an increased ambient temperature of the wellbore 100. In yet other embodiments, the swellable element 114 can include an inflatable bladder or device capable of swelling in response to an injection of a fluid.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A gravel pack system for use in a wellbore, comprising:

a screen assembly to filter particulates, the screen assembly being disposed around a completion string tubular;

an isolation device disposed about the completion string tubular and configured to sealingly engage an inside surface of the wellbore thereby isolating a first wellbore zone from a second wellbore zone;

a first shunt tube disposed between the completion string tubular and the inside surface of the wellbore, the first shunt tube extending through the isolation device;

a second shunt tube disposed between the completion string tubular and the inside surface of the wellbore, the second shunt tube positioned below a lower end of the first shunt tube; and a swellable element disposed about the completion string tubular below the isolation device and between the lower end of the first shunt tube and an upper end of the second shunt tube, the swellable element configured to swell in response to an input stimulus to sealingly engage the inside surface of the wellbore, wherein the swellable element, once swelled, prevents fluid communication between the first and second shunt tubes and between the first and second wellbore zones.

2. The system of claim 1, wherein the screen assembly is an inflow control device.

3. The system of claim 1, wherein the input stimulus comprises water or a hydrocarbon fluid.

4. The system of claim 1, wherein the input stimulus comprises an increased temperature in the wellbore.

5. The system of claim 1, wherein the swellable element provides a hydraulic seal within the wellbore for a gas hydrocarbon fluid.

6. The system of claim 1, wherein the first shunt tube is arranged within the first wellbore zone and adapted to convey a gravel slurry through the isolation device to the second wellbore zone.

7. The system of claim 6, wherein the input stimulus is provided to the swellable element via the shunt tubes.

8. The system of claim 1, wherein the first and second shunt tubes do not extend through the swellable element.

9. A method of wellbore completion, comprising:

running a completion string into a wellbore, the completion string having a screen assembly, upper and lower shunt tubes, and an isolation device that sealingly engages an inside surface of the wellbore to isolate a first wellbore zone from a second wellbore zone, wherein the upper shunt tubes are arranged within the first wellbore zone and extend through the isolation device into the second wellbore zone, and the lower shunt tubes are arranged within the second wellbore zone;

conveying a gravel slurry to the first wellbore zone;

conveying overflow gravel slurry from the first wellbore zone to the second wellbore zone via the upper shunt tubes; and expanding a swellable element disposed between a lower end of the upper shunt tubes and an upper end of the lower shunt tubes from a first diameter to a second larger diameter to sealingly engage the inside surface of the wellbore to prevent fluid communication between the first and second wellbore zones and between the upper and lower shunt tubes.

10. The method of claim 9, further comprising gravel-packing the wellbore in a single wellbore run-in.

11. The method of claim 9, wherein expanding the swellable element comprises inputting a stimulus into the wellbore to react with the swellable element.

12. The method of claim 11, wherein the stimulus comprises water or a hydrocarbon fluid.

13. The method of claim 9, wherein expanding the swellable element comprises pumping a fluid into the swellable element to expand its outer diameter.

14. A gravel pack system for use in a wellbore, comprising:

a completion string tubular;

a screen assembly disposed around at least a portion of the completion string tubular;

an isolation device disposed around at least a portion of the completion string tubular and configured to sealingly engage an inside surface of the wellbore thereby isolating a first wellbore zone from a second wellbore zone;

upper shunt tubes arranged within the first wellbore zone and extending through the isolation device to the second wellbore zone;

lower shunt tubes arranged within the second wellbore zone; and a swellable element disposed about the completion string tubular and between a lower end of the upper shunt tubes and an upper end of the lower shunt tubes, the swellable element being configured to expand radially to sealingly engage the inside surface of the wellbore, wherein the swellable element, once expanded, prevents fluid communication between the first and second wellbore zones within the wellbore and fluid communication between the upper and lower shunt tubes.

15. The system of claim 14, wherein overflow gravel slurry in the first wellbore zone is funneled through the upper shunt tubes and into the lower shunt tubes to feed gravel slurry to the second wellbore zone.

16. The system of claim 14, wherein the swellable element provides a hydraulic seal within the wellbore for preventing gaseous hydrocarbons from flowing between the first and second wellbore zones.

17. The system of claim 16, wherein the swellable element expands in response to an input stimulus.

18. The system of claim 17, wherein the input stimulus comprises water or a hydrocarbon fluid.

19. The system of claim 17, wherein the input stimulus comprises an increase in ambient temperature of the wellbore.

20. The system of claim 16, wherein the swellable element is an inflatable bladder that expands in response to an influx of a fluid into the swellable element.

* * * * *